US006949017B2

(12) United States Patent
Koschel et al.

(10) Patent No.: US 6,949,017 B2
(45) Date of Patent: Sep. 27, 2005

(54) HOOD MOUNTING

(75) Inventors: Christian Koschel, Augsburg (DE); Markus Hartmann, Mauerstetten (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/915,289

(22) Filed: Aug. 10, 2004

(65) Prior Publication Data

US 2005/0037702 A1 Feb. 17, 2005

(30) Foreign Application Priority Data

Aug. 11, 2003 (DE) ..... 103 36 873

(51) Int. Cl.[7] ..... B24B 55/04

(52) U.S. Cl. ..... 451/358; 451/359; 451/451; 451/452

(58) Field of Search ..... 451/358, 359, 451/451, 452, 453, 454, 455, 456; 30/390, 391, 124, 377; 83/478

(56) References Cited

U.S. PATENT DOCUMENTS 4,059,930 A * 11/1977 Alessio ..... 451/451
4,924,635 A * 5/1990 Rudolf et al. ..... 451/344
5,263,252 A * 11/1993 Bruggink ..... 29/897.32
5,386,667 A * 2/1995 Hausslein et al. ..... 451/344
5,766,062 A * 6/1998 Edling ..... 451/451
6,464,573 B1 * 10/2002 Keller ..... 451/451
6,561,887 B2 * 5/2003 Lai et al. ..... 451/358
6,688,955 B2 * 2/2004 Ruey-Zon ..... 451/360
6,869,346 B2 * 3/2005 Wendt et al. ..... 451/342

FOREIGN PATENT DOCUMENTS

CH 682732 A * 11/1993

* cited by examiner

*Primary Examiner*—George Nguyen
(74) *Attorney, Agent, or Firm*—Abelma, Frayne & Schwab

(57) ABSTRACT

A protective hood assembly (6) for a tool machine (2) is formed of a housing with a protective hood (10), to a securing assembly (8, 8', 8") relative to the housing (4) in different rotary positions, wherein at least one lock-in part (30, 30') is provided, which can be brought along a direction of installation (M) into a receiving region (36) of a locking housing (16) of the securing assembly (8) and at which, by rotating, can be brought into a bayonet-like engagement and wherein locking means (32, 32') are provided on the protective hood, the locking means being capable of being locked in different locking positions with counter locking means (26, 26') of the securing assembly (8). The receiving region (36) is limited on a side facing the housing (4) at least in part by an abutting wall (34, 34', 34*ä*, 34"*b*), which is mobile.

11 Claims, 5 Drawing Sheets

HOOD MOUNTING

The invention relates to a protective hood for a tool machine, in particular an angle grinding machine, including a housing with a protective hood, which can be attached on a fastening assembly in different rotary positions relative to the housing, for example, at least one lock-in part is provided, which can be brought in a installation direction into a receiving zone, formed in a securing assembly and can be brought into a bayonet-type connection by rotating it and whereby the protective hood is provided with a locking means, which can be locked in different locking positions using counter-locking means of the securing assembly.

BACKGROUND OF THE INVENTION

This type of protective hoods have the advantage that the protective hood is installed and removed on the tool machine without the use of tools. In addition, the protective hood in the secured condition, depending on need, can be brought, relative to the tool machine, also without the use of tools from one locked position into another.

CH 682 732 A5 discloses a protective hood arrangement, where the protective hood has an annular holding part, on which two brackets project inwardly. At one fastening flange of the tool machine, an annular receiving groove formed by two access recesses towards the free end of the fastening flange extend, whose cross-section and arrangement correspond to the form and arrangement of the brackets on the protective hood. When installing the protective hood, the brackets are urged over the access recesses into the receiving groove and then by rotating, together with the later brought into a bayonet-type engagement. In addition, on an underside of the tool machine, around the fastening flange, depressions are formed into which locking cams of the protective hood can interlock and which project axially on a free end part of an annular holding part.

The drawback in the prior art protective hood arrangement is that the features for the optional fixing of the protective hood in different locking positions are relatively expensive and consequently result in high costs of manufacture. In addition, the receiving groove in cross-section must be relatively precisely matched to the thickness of the brackets, in order to prevent a disturbing rattling during operation. At the same time, this precise matching of the receiving groove to the dimensions of the brackets results in a slight sticking, particularly when the brackets are slightly bent. This can result in a misalignment of the protective hood into a new locking position or can result in substantial problems at the time of their installation or dismantling.

SUMMARY OF THE INVENTION

The object of the present invention is to eliminate the aforementioned drawbacks in a protective hood arrangement on a tool machine and to provide easy installation and removal by virtue of a simple construction.

According to the invention, this object is achieved in that the receiving region is limited on a side facing the housing; that is, it is limited at least partially by an abutting wall, which is movable in the direction of installation.

In this way, the width of the receiving region can be changed in size in the direction of installation; that is, in the direction, in which the protective hood is urged onto or into the securing assembly. Consequently, tolerances between the width of the lock-in part and the receiving region can be compensated. Accordingly, sticking of the lock-in part with the securing assembly can be prevented and consequently problem-free installation and dismantling of the protective hood on the tool machine is possible.

Advantageously, the receiving region is limited on a side facing away from the housing; that is, opposite to the installation direction, at least in part by a locking wall, on which the locking means or complementary locking means is formed. In this way, the receiving region serves not only in the axial securement of the protective hood on the tool machine, but also as part of the locking assembly for optional securing of the protective hood in the rotary direction relative to the tool machine. In this manner, a relatively simple and space-saving protective hood arrangement is obtained.

Preferably, the receiving region is configured on the securing assembly of the tool machine and the lock-in part on the protective hood, whereby the part of the protective hood assembly on the protective hood side can be formed particularly simply and robustly and the manufacturing costs of the protective hood can be kept low.

In a preferred embodiment, the abutting wall is formed by a spring assembly. This results on the one hand in that the lock-in part is securely clamped in the receiving zone so that a rattling of the tool machine during operation is prevented. On the other hand, the spring assembly can urge the locking means of the protective hood into the complementary locking means of the tool machine and thus provide secure interlocking engagement. In order to rotate the secured protective hood into a new locking position relative to the tool machine, the protective hood must be urged in the installation direction against the spring force of the spring assembly, whereby the locking elements of the protective hood are released from the complementary locking means of the securing assembly.

When this is done it is advantageous if the spring assembly has a helical spring, whose one end forms the mobile abutting wall, whereby the mobility of the abutting wall can be established in a particularly simple and cost-effective fashion.

In an alternative embodiment, the abutting wall is formed by a conical ring arrangement with a rotatably mounted conical ring, which has at least one inclined surface on the side facing away from the receiving zone, the inclined surface being adjacent axially or in the installation direction to a complementary inclined surface extending in an opposite running direction. In this way, it is possible, to achieve the displacement of the abutting wall in the direction of installation by rotating the conical ring. When this is done, when the conical ring is rotated by the co-operation of the abutting inclined surfaces, a certain lifting action is produced in the axial direction of the conical ring. Accordingly, the protective hood can be securely clamped especially in a stable manner to the securing assembly.

Advantageously, when this is done, the complementary inclined surface is formed on a second rotationally mounted conical ring. When this is done, the displacement of the abutting wall can be effected also by rotating the second conical ring, whereby more possibilities for the arrangement of the operating means are given for adjusting the abutting wall.

Preferably, the conical ring arrangement, relative to the rotary movement of at least the one or both conical rings, can be secured by a locking assembly, whereby a stable securement of the protective hood to the tool machine is possible.

In this case, it is advantageous, if the locking assembly has a notch urged radially against the conical ring assembly by means of a spring force, the notch being interlockable in at least one locking receptacle on the external side of the conical ring assembly. This type of locking assembly can be manufactured particularly simply and can be easily accessible.

In a particularly preferred embodiment of the receiving region on the side facing the housing; that is, in the direction of installation, the one part is limited by the spring assembly and on the other part by the conical ring assembly. In this fashion, on the one hand a stable securement of the hinge element in the receiving region is made possible by the conical ring assembly. In addition, rattling of the protective hood on the tool machine is prevented by the spring assembly even in the released position of the conical ring assembly.

In this case, the spring assembly has an external circumference, which corresponds approximately to an open internal diameter of the conical ring assembly. In this way, a stable guiding of the spring assembly is obtained, whereby again problems at the time of installation, dismantling and adjusting of the protective hood can be prevented.

BRIEF DESCRIPTION OF THE INVENTION

The invention will be explained below in more detail using an exemplary embodiment. Wherein.

DETAILED DESCRIPTION OF THE INVENTION

Figure 1:
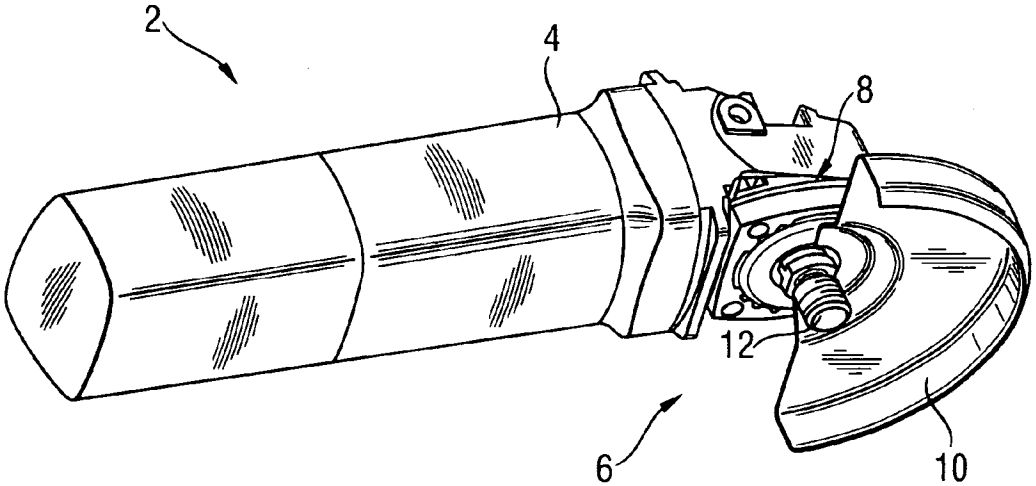
FIG. 1 is a perspective illustration of the tool machine with a protective hood.

FIG. 1 represents a tool machine 2 in the form of an angle grinder having a housing 4, on whose tool side end a protective hood assembly—overall represented by 6—is provided. The protective hood assembly 6 consists essentially of a securing unit 8 connected securely with the housing 4, at which a protective hood 10 is removably fastened without the aid of tools.

Figure 2:
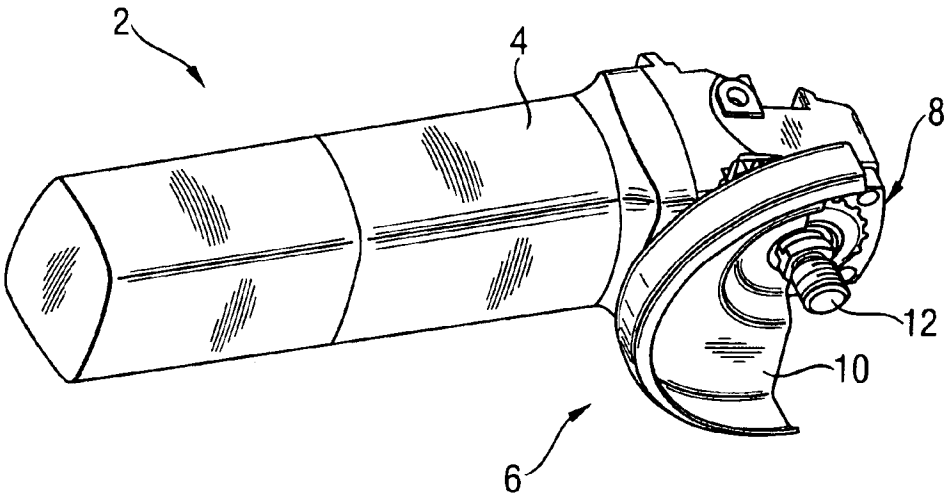
FIG. 2 is a perspective illustration of the tool machine according to FIG. 1 with the protective hood rotated 180°.

As represented in FIG. 1 in conjunction with FIG. 2, the protective hood can be rotated relative to the housing 4 of the tool machine into different locking positions. The structure of the protective hood assembly 6 provided for this purpose can be seen in FIG. 3.

Figure 3:
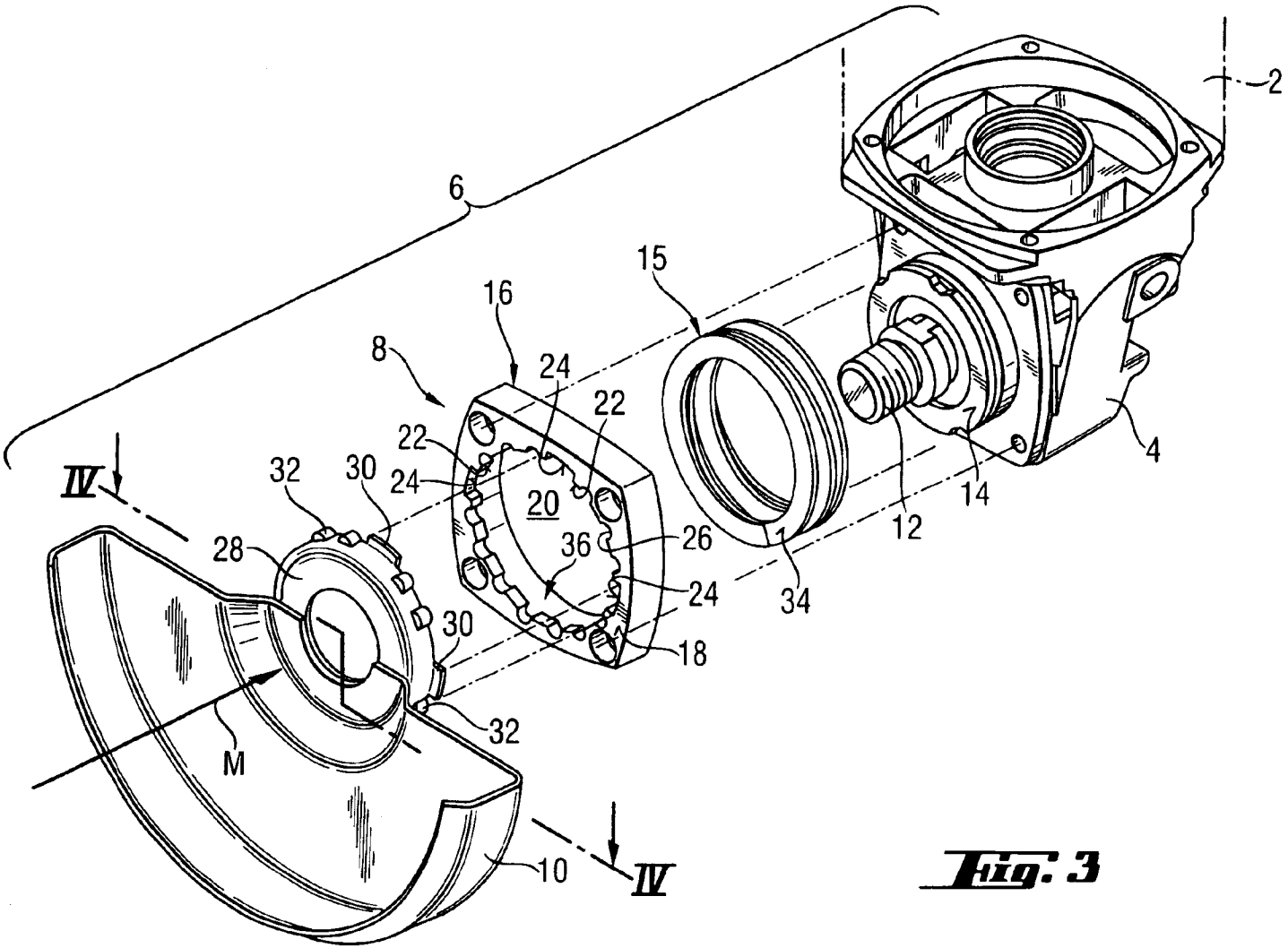
FIG. 3 is a perspective exploded view of a protective hood arrangement according to the invention.
Figure 4:
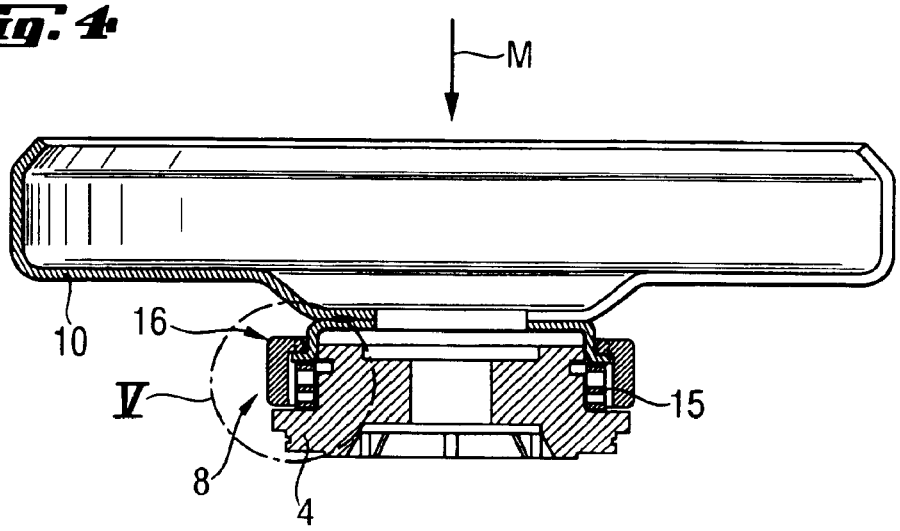
FIG. 4 represents a section along the plane IV—IV through the protective hood assembly according to FIG. 3 in the assembled condition.

The securing assembly 8 of the protective hood arrangement 6 represented in an exploded view in FIG. 3 has, around a tool receptacle 12, which is used for attachment of a tool (not shown), such as in particular a cutting or grinding disk, a substantially annular fastening flange 14 fixedly attached to the housing. A cylindrical helical spring 15 is arranged surrounding the fastening flange 14, the spring supported on one side upon the housing 4, as is shown in particular in FIG. 4 or the detail view in FIG. 4 shown in FIG. 5.

The securing unit 8 has in addition a locking housing 16, which in the assembled condition accommodates the fastening flange 14 and the helical spring 15 on its inside and has on its side facing away form the housing 4 a locking wall 18, in which an essentially circular receiving opening 20 is formed. As can be seen in FIG. 3, three access recesses 24 are formed in the radial direction on the edge 22 of the circular receiving opening 20. In addition, a plurality of complementary locking means 26 are formed on the edge 22 of the locking wall 18 in the form of radial locking receptacles.

A substantially circular holding part 28 is formed on the protective hood 10, whose external periphery is matched to the inside diameter of the receiving opening 20 of the locking housing 16. Three lock-in parts 30 and a plurality of locking means 32 in the form of locking cams project radially outwards from the holding element 28. The lock-in parts 30 and the locking means 32 are arranged on the holding part 28 in such a way and have such a cross-section in an installation direction M that the holding element 28 can be inserted at least in a certain orientation relative to the securing assembly 8 with the lock-in part 30 into the access recesses 24 and with the locking means 32 into the complementary locking means 26 of the locking housing 16 along the installation direction M.

At the time of this introduction into the locking housing 16, the holding part 28 comes into contact with a displaceable abutting wall 34, formed by the face side of the helical spring 15 facing away from the housing 4 and limits the receiving zone 36 on the side facing the housing 4. As soon as the lock-in parts 30 and the locking means 32, the access openings 24 and the complementary locking means 26 have passed in the installation direction M, the protective hood 10 is rotated, so that the lock-in parts 30 grip bayonet-like behind the locking wall 18 on the edge 22. In this fashion, the protective hood 10 is secured in the installation direction M to the housing 4.

Instead of the illustrated three lock-in parts 30 and the corresponding three access recesses 24, any other number can also be selected. By way of example, one embodiment with four each of lock-in parts 30 and access recesses 24 has been shown to be advantageous. In this embodiment (not shown), at least three of the lock-in parts 30 abut on the locking wall 18 during the bayonet-like interlocking.

In each case, the lock-in parts 30 are arranged in an essentially annular receiving region 36 during the interlocking, the receiving zone being limited in the installation direction M at least in part by the abutting wall 34 and opposite to the installation direction M at least in part by the locking wall 18 of the locking housing 16.

The protective hood 10 or the lock-in parts 30 in the receiving region 36 can now be rotated so far, until the protective hood 10 is positioned in a desired position relative to the rest of the tool machine 2, in which the locking means 32 are oriented opposing the installation direction M in overlap with the complementary locking means 26. The locking means 32 are now, as a result of the spring 15, urged into the complementary locking means 26 and accordingly the protective hood 10 is held in this locked position.

If an alternate orientation of the protective hood 10 is desired relative to the housing 4, the latter must merely be urged in the direction of installation direction M against the spring force of the helical spring, until the locking means 32 are moved out of the complementary locking means 26 and the locking engagement is accordingly released. Then the protective hood 10 can be rotated into a new locking position, wherein the locking means 32 are again biased by the helical spring 15 into corresponding complementary locking means 26.

For dismantling the protective hood 10, these are brought again into a position, wherein both the lock-in parts 30 opposite to the installation direction M align with the access recesses 24 and the locking means 32 with the counter locking means 26. The lock-in parts 30 and the locking parts 32 are then urged by the spring force of the helical spring 15 into the access recesses 24 or into the complementary locking means 26, whereupon the holding part 28 of the protective hood 10 can be separated from the securing assembly 8 of the housing 4. When this is done it is possible to provide only one single such installation/dismantling position or even two or more of same over the entire range of rotation of 360° of the protective hood 10 relative to the housing 4.

Figure 6:
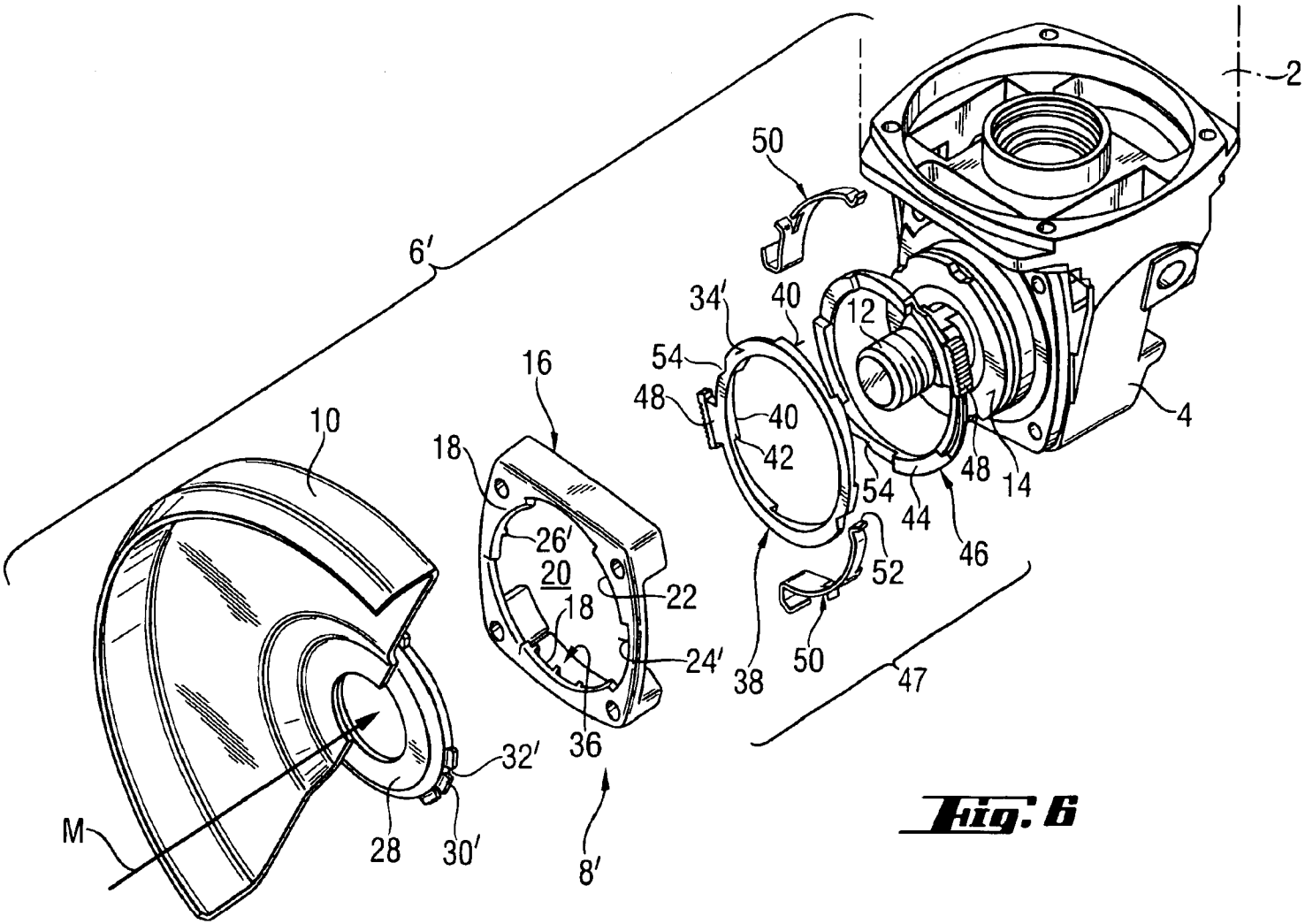
FIG. 6 represents a perspective exploded view of an alternative protective hood assembly according to the invention with a conical ring assembly.

FIG. 6 represents an alternative embodiment of a protective hood arrangement 6'. Corresponding elements are identified using the same references as in FIGS. 1 to 4; elements with an modified form but having the same function are identified using the same references but with a prime.

In this protective hood arrangement 6', abutting wall 34', which at least partially limits the receiving zone 36 for the lock-in parts 30 in the direction of installation M, are formed by a first conical ring 38. This first conical ring 38 has several inclined surfaces 40 on the side facing away from the receiving region 36 or the edge, which are formed by conical elevations 42. In the installed condition, the inclined surfaces 40 abut on complementary inclinations 44 of a second conical ring 46, which are formed opposite to the direction to the inclined surfaces 40 of the first conical ring 38. This second conical ring 46 is supported on the side of the housing 4 facing away from the first conical ring 38. Both conical rings 38, 46 together form a conical ring assembly 47.

Both conical rings 38, 46 each have an actuating element 48 extending radially outwards. The two conical rings 38, 46 can be rotated against each other using the actuating elements 48. When rotating, the inclined surfaces 40 of the first conical ring 38 are moved along the complementary inclined surfaces 44 of the second conical ring 46, whereby the first conical ring 38, depending on the direction of rotation, is either urged away from the second conical ring or abuts it more intimately. Similarly, when this is done the receiving region 36 is either reduced or enlarged.

In addition, a locking member 50 in the form of a spring arm is arranged on both conical rings 38, 46, which in the assembled condition is securely clamped at one end on the housing 4 (not shown). At its free end, the locking members 50 each have a locking notch 52. The locking notch 52 is urged by the spring arm 50 against the outer periphery of the respective conical ring 38, 46. In their turn, the conical rings 38, 46 each have on their outer periphery two locking recesses 54 in the form of notches, into which the locking notches 52 can interlock in the corresponding position of the respective conical ring 38, 46 relative to the respective locking members 50.

Figure 5:
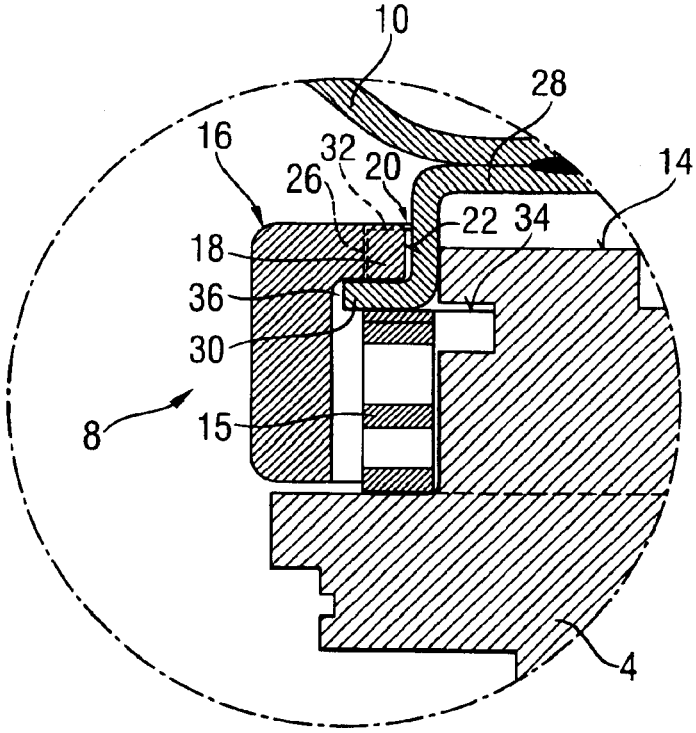
FIG. 5 represents an enlarged detailed section in zone V of FIG. 4.

A further difference relative to the embodiment according to FIGS. 3 to 5 resides in the fact that on the holding part 28 of the protective hood 10 a plurality of lock-in parts 30' protrude radially outwards and which form gaps between themselves and act as locking means 32'. On the locking housing 16 open access recesses 14' are formed on the one side radially inwardly. On the other hand, a plurality of pit-like complementary locking means 26' project from the locking wall 18 in the direction of installation, and complementary locking means project thereinto in the assembled condition into the receiving zone 36 between the locking wall 18 and the abutting wall 34'.

When installing the protective hood 10, its holding part 28 is positioned according to the procedure in the case of the embodiment according to FIGS. 3 to 5, in such a way opposite to the locking housing 16, that the lock-in parts 30' can be introduced into the access recesses 24' of the locking housing 16. When this is done, both conical rings 38, 46 must be situated in a rotary position relative to each other, in which the first conical ring 38 abuts as closely as possible with the second conical ring 46. In this fashion, the receiving zone 36 between the locking wall 18 and the abutting wall 34' has the maximum width in the direction of installation. In this way, the lock-in parts 30' can be inserted into the locking housing 16 or the receiving zone 36, until they not only have completely passed the access recesses 24' but also the cam-shaped complementary locking means 26' in the installation direction.

Then the protective hood is rotated into a desired position relative to the housing 4, in which the locking means 32' align against the direction of installation M with the complementary locking means 26' of the locking housing 16. Then by mutually rotating the conical rings 38, 46 towards each other, the first conical ring 38 is urged against the direction of installation M. When this is done, the first conical ring 38 together with the abutting wall 34 urges against the lock-in parts 30' and thereby pushes the locking means 32' into engagement with the complementary locking means 26' until the lock-in parts 30' come into contact with the locking wall 18.

In this position, the locking recess 52 of the two locking assemblies 50 engage into the respective locking groove 54 of the conical rings 38, 46. Thereby, the conical ring assembly 47 is secured and the protective hood 10 is reliably secured in the set locking position.

For adjusting or dismantling the protective hood 10, at least one of the conical rings 38, 46 must be released from engagement with the respective locking assembly 50 by operating the actuation element 48 and rotated relative to the other conical ring 46, 38, so that both conical rings 38, 46 closely abut against each other. Even in this release position of the conical ring assembly 47, the locking notches 52 of the locking assembly 50 slide into the respective locking receptacle 54, in order to secure the conical ring assembly 47. Then the protective hood 10 can be brought into a new locking position removed from the housing 4.

Figure 7:
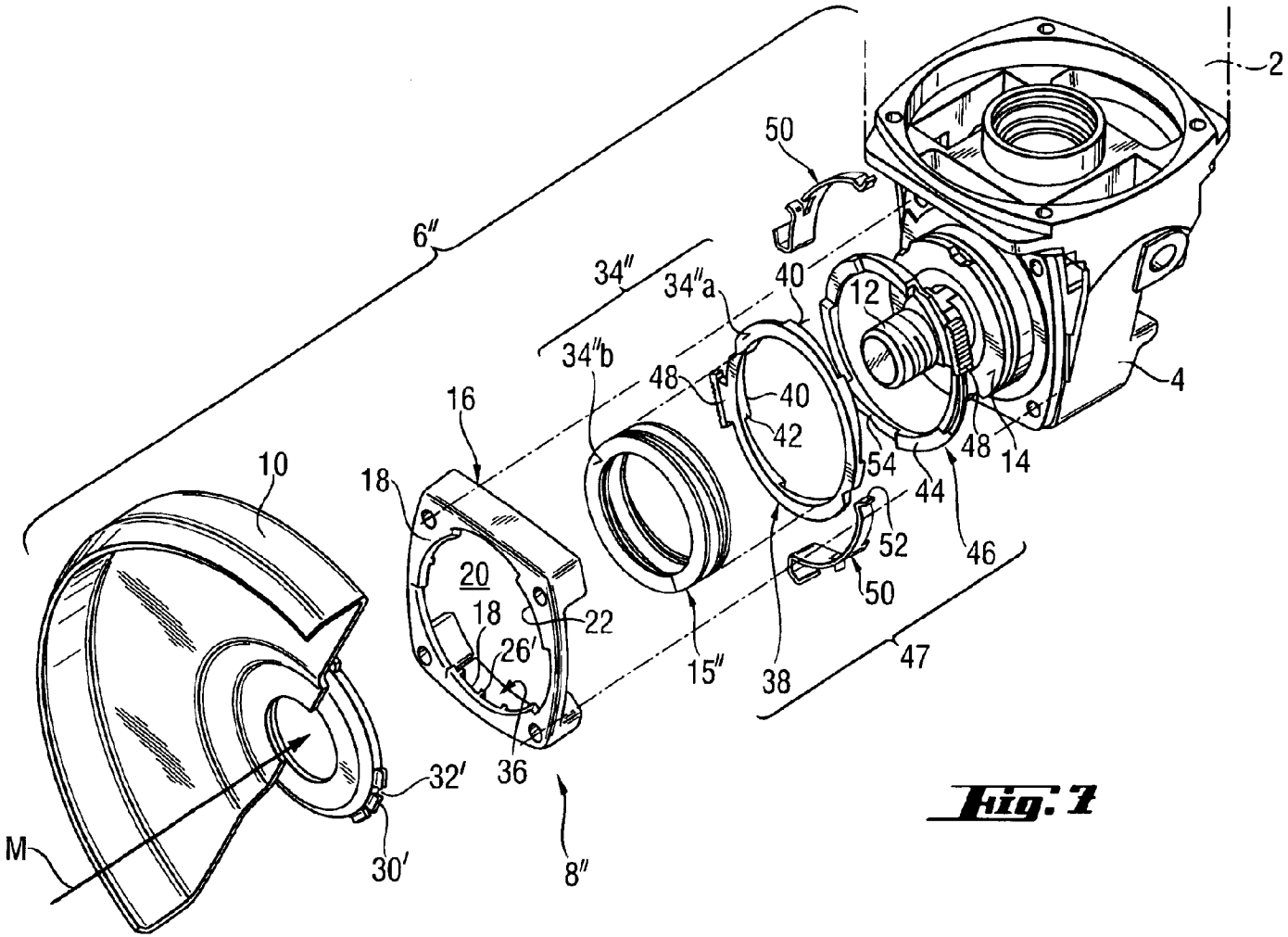
FIG. 7 represents a perspective exploded representation of a further alternative protective hood assembly according to the invention with a combination spring assembly and conical ring assembly.

FIG. 7 represents a further alternative protective hood assembly 6" such that it substantially agrees with the embodiment according to FIG. 6. Corresponding elements are identified using the same references as in FIGS. 6; elements with an modified form but having the same function are identified using the same references but with a double prime.

The securing assembly 8" of the protective hood assembly 6" according to FIG. 7 in comparison with the embodiment according to FIG. 6, has in addition a helical spring 15", which is inserted into the conical ring assembly 47 and is guided by same in the direction of installation. To do this, the helical spring 15" has an external diameter, that is slightly smaller than the internal diameter of the open cross section of the conical ring assembly 47, in order to make possible a relative rotary movement between the two elements.

By virtue of the additional helical spring 15" the abutting wall 34" in the direction of installation in this embodiment of the securing assembly 8" is formed in part with 34"*b* by the helical spring 15" and in part with 34"*a* by the first conical ring 38.

The mode of operation of the protective hood assembly 6" is the same as in the embodiment according to FIG. 6. By virtue of such arrangement, the helical spring 15" must be compressed, however, in accordance with the procedure in the case of the embodiment according to FIGS. 3 to 5, when (dis-) assembling or rotating the protective hood 10 into a new locked position against the force of the helical spring 15". Otherwise, the helical spring 15 in the assembled condition of the protective hood 10 assures that the locking means 32' is interlocked with the complementary locking means 26' and the lock-in parts 30' are urged from within against the direction of installation to the locking wall, in order to make possible also in the case of unsecured conical ring arrangement 47 a tight and secure setting of the protective hood 10 on the housing 4.

What is claimed is:

1. A protective hood assembly (6) for a tool machine (2) comprises a housing (4) with a protective hood (10), a securing unit (8, 8', 8") for securing said protective hood (10) to said housing (4) in a number of spaced rotary positions, at least one lock-in part (30, 30') of said hood (10) can be moved in a direction of installation (M) of said hood (10) on said housing (4) into a receiving region (36) located between said hood (10) and said housing (4) and can be rotated into a bayonet-like engagement and locking means (32, 32') on said protective hood (10) which interlock in different locking positions with complementary locking means of said securing unit (8, 8', 8") and said receiving region (36) is limited on a side facing said housing at least in part by an abutting mobile wall (34, 34', 34"*a*, 34"*b*).

2. A protective hood assembly, as set forth in claim 1, wherein said receiving region (36) on a side facing away from said housing (4) is limited by a locking wall (18) with a locking means (32, 32') engaged with a complementary locking means (26, 26').

3. A protective hood assembly, as set forth in claim 2, wherein said receiving region (36) is formed on said securing unit (8, 8', 8") of said tool machine (2) and said lock-in part (30, 30') is formed on said protective hood (10).

4. A protective hood assembly, as set forth in claim 3, wherein said abutting wall (34) is formed by a spring unit.

5. A protective hood assembly, as set forth in claim 4, wherein said spring unit comprises a helical spring (15, 15") having said movable abutting wall (34, 34"*b*).

6. A protective hood assembly, as set forth in claims 1, wherein said abutting wall (34', 34"*a*, 34"*b*) comprises a conical ring assembly (47) including a rotatably held conical ring (38) having at least one inclined surface (40) on a side facing away from said receiving region (36) and abuts a complementary inclined surface (44) extending in an opposite direction relative to said included surface (40).

7. A protective hood assembly, as set forth in claim 6, wherein the complementary inclined surface (44) is formed on a second conical ring (46).

8. A protective hood assembly, as set forth in claim 6, wherein said conical ring assembly (47) is secured at least in part by a locking member (50).

9. A protective hood assembly, as set forth in claim 8, wherein said locking member (50) has a locking notch (52) biased by a spring force radially against said conical ring assembly (47) and is lockable in at least one locking recess (54) on the exterior of said conical ring assembly (47).

10. A protective hood assembly, as set forth in claim 6, wherein said receiving region (36) is limited on a side facing the housing (4) and by said spring unit and by the conical ring assembly (47).

11. A protective hood assembly, as set forth in claim 10, wherein said spring unit has an outer radius corresponding approximately to an open inner diameter of said conical ring assembly (47).

* * * * *